US005547247A

United States Patent [19]

Dixon

[11] Patent Number: 5,547,247

[45] Date of Patent: Aug. 20, 1996

[54] PASSENGER TRAY TABLE WITH INGRESS/EGRESS POSITION

[75] Inventor: Richard W. Dixon, Winston-Salem, N.C.

[73] Assignee: Burns Aerospace Corporation, Winston-Salem, N.C.

[21] Appl. No.: 291,182

[22] Filed: Aug. 16, 1994

[51] Int. Cl.[6] ..... A47B 39/00

[52] U.S. Cl. ..... 297/145; 297/150; 297/162

[58] Field of Search ..... 297/145, 149, 297/150, 161, 162, 188.15, 188.16, 188.17

[56] References Cited

U.S. PATENT DOCUMENTS

| | | | |
|---|---|---|---|
| 137,738 | 4/1873 | Trevitt | 297/150 X |
| 1,217,231 | 2/1917 | Soper | 297/150 X |
| 3,506,304 | 4/1970 | Smittle et al. | 297/162 |
| 4,852,940 | 5/1989 | Kanigowski | 297/145 |
| 5,087,096 | 2/1992 | Yamazaki | 297/145 |
| 5,193,765 | 3/1993 | Simpson et al. | 297/145 X |
| 5,195,709 | 3/1993 | Yasushi | 297/188.16 X |
| 5,275,482 | 1/1994 | Grant | 312/223.3 X |

*Primary Examiner*—Peter R. Brown
*Assistant Examiner*—David E. Allred
*Attorney, Agent, or Firm*—W. Thad Adams, III, P.A.

[57] ABSTRACT

A stowable seat tray table for use with a seat, such as a passenger seat, having a tray table stowage compartment on one side of the seat. The tray table includes a tray table having a long side and a perpendicular short side with the table connected to a seat for permitting the table to be moved into and out of the stowage compartment. The table pivots and translates. The pivot movement and the translating movement permit the table to be moved when out of the stowage compartment between a use position wherein the long side of the table extends across the seat from one side to an opposing side for use by the occupant and an ingress/egress position wherein the table is pivoted about a vertical axis and laterally translated towards the stowage compartment to provide sufficient room for the passenger to ingress or to egress from the seat.

7 Claims, 9 Drawing Sheets

PASSENGER TRAY TABLE WITH INGRESS/EGRESS POSITION

TECHNICAL FIELD AND BACKGROUND OF THE INVENTION

This invention relates to a passenger seat tray table which has the capability to be easily and quickly moved from its normal use position in front of the passenger to a side position to permit easy egress and ingress without stowing the table. The table is the type which is stowed in a side compartment of the seat, usually under one of the armrests with the compartment cover being the armrest. The ingress/egress position also permits the table to function as a "cocktail" table of sufficient size to hold a drink glass and small plate, while leaving the area in front of the passenger open so that the passenger can cross his or her legs, or hold a book or newspaper without interference from the table. The table can also be moved into a position sufficiently out of the way so that neighboring passengers can move past without the table being stowed in the armrest compartment.

Prior art U.S. Pat. No. 4,944,552 to Harris and U.S. Pat. No. 4,852,940 to Kanigowski permit only limited movement of the table out of the passenger's way, and even then the table extends further out into the area in front of the passenger, making movement past the seat by another passenger difficult or impossible. These patents also disclose tables which have relatively small parts which are subject to breakage and wear.

SUMMARY OF THE INVENTION

Therefore, it is an object of the invention to provide a seat tray table which has a use position and an ingress/egress position.

It is another object of the invention to provide a seat tray table which pivots from a use position into a ingress/egress position, in which position the tray can also serve as a small cocktail table.

It is another object of the invention to provide a seat tray table which permits movement past the seat by neighboring passengers while the table is in the ingress/egress position.

It is another object of the invention to provide a seat tray table which is moved to an ingress/egress position by a combination pivot and slide mechanism.

It is another object of the invention to provide a seat tray table which has an adjustable ingress/egress position.

These and other objects of the present invention are achieved in the preferred embodiments disclosed below by providing a stowable seat tray table for use with a passenger seat having a tray table stowage compartment on one side of the seat. The tray table includes a table top having a long side and a perpendicular short side with connecting means for connecting the table to a seat and for permitting the table to be moved into and out of the stowage compartment. The connecting means includes table pivot means and table translating means. The pivot means and the table translating means cooperate with the table for moving the table when out of the stowage compartment between a use position wherein the long side of the table extends across the seat from one side to an opposing side for use by the passenger and an ingress/egress position wherein the table is pivoted about a vertical axis by the pivot means and laterally translated towards the stowage compartment by the translating means to provide sufficient room for the passenger to ingress to or egress from the seat.

According to one preferred embodiment of the invention, the tray table is comprised of two table top sections hinged along an axis perpendicular to the long side of the table for permitting the table to be folded for stowage and for use as a small cocktail table.

According to another preferred embodiment of the invention, the table includes locking means cooperating with the table pivot means for locking the table in the use position.

According to yet another preferred embodiment of the invention, the table pivot means comprises a mounting block attached to a bottom surface of the table, a pivot block pivotally mounted on the mounting block, and an arcuate guide slot formed in the pivot block. A guide pin is mounted on the mounting block in a fixed position and extends upwardly into the guide slot for limiting pivotal movement of the pivot block to the arc of the arcuate guide slot.

According to yet another preferred embodiment of the invention, the locking means comprises a hook for holding the guide pin in a predetermined locked position in the guide slot.

According to yet another preferred embodiment of the invention, the hook is pivotally mounted on the pivot block and includes biasing means for biasing the hook over the guide slot in an interference position with relation to the guide pin.

Preferably, a predetermined force on the hook overcomes the biasing means and moves the pin past the hook into the locked position.

According to yet another preferred embodiment of the invention, the locking means includes an unlocking lever carried by the hook for releasing the guide pin from its locked position in the guide slot.

According to yet another preferred embodiment of the invention, the mounting block is mounted on the bottom surface of the table for translational movement relative to the table.

According to yet another preferred embodiment of the invention, the table includes slide means carried on the bottom surface of the table for carrying the mounting block for translational movement of the mounting block along the slide means.

According to yet another preferred embodiment of the invention, the slide means comprises first and second parallel tracks mounted to the bottom surface of the table, and the mounting block includes first and second parallel-extending channels within which the parallel tracks are mounted for sliding, translational movement.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
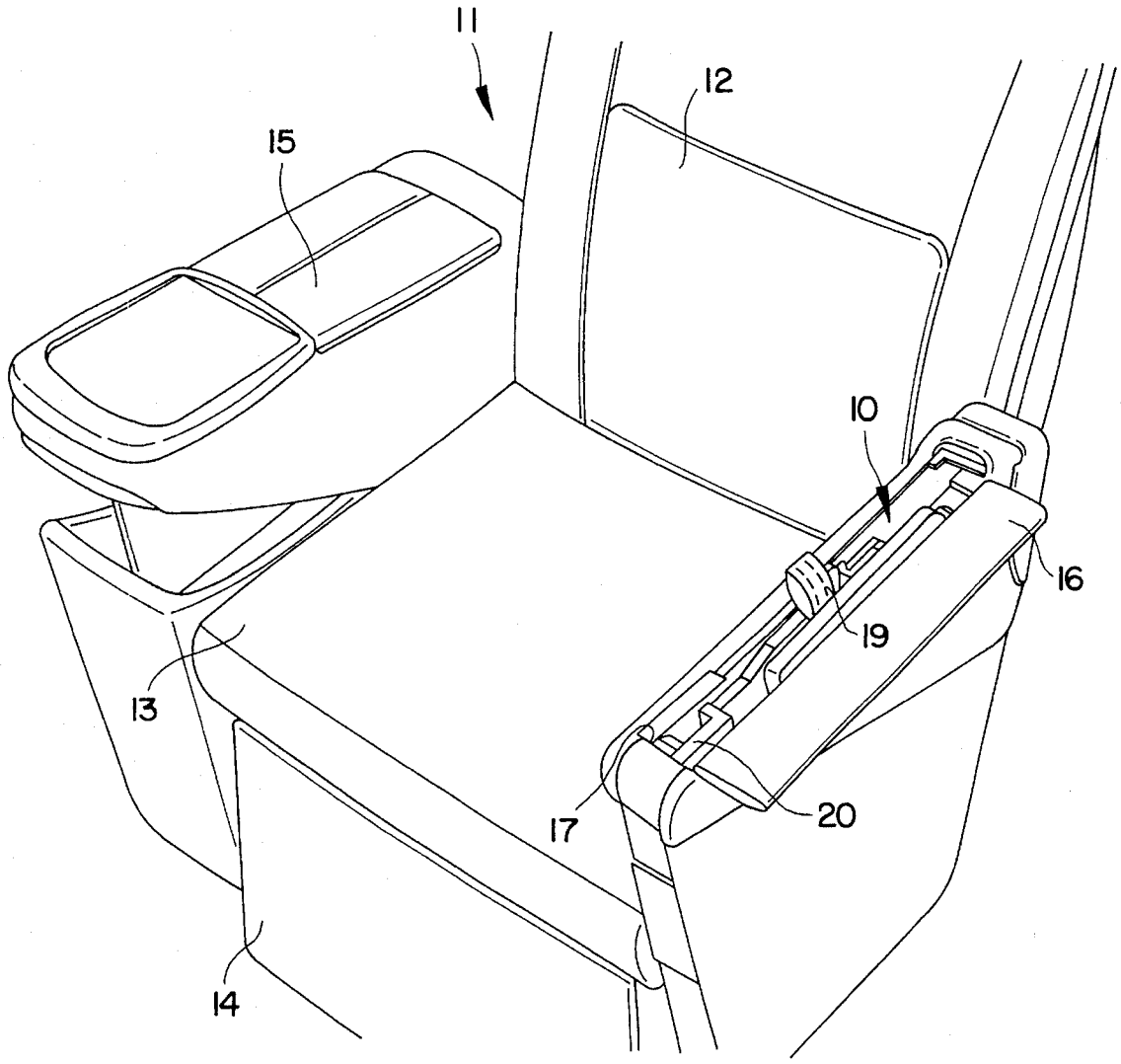
FIG. 1 is a partial perspective view of a passenger seat including a seat tray table enclosed in a compartment in one of the seat armrests.

Referring now specifically to the drawings, a seat tray table according to the present invention is illustrated in FIG. 1 and shown generally at reference numeral 10. Tray table 10 is shown mounted in a passenger seat 11, which may be one of many types of seats intended for use in aircraft, buses and other transportation modes. Furthermore, even though referred to as a tray table for use with a passenger seat, the seat could be used for other purposes, such as in theaters. The tray table 10 is referred to as being for use in a passenger seat because that is its principal intended use.

Figure 8:
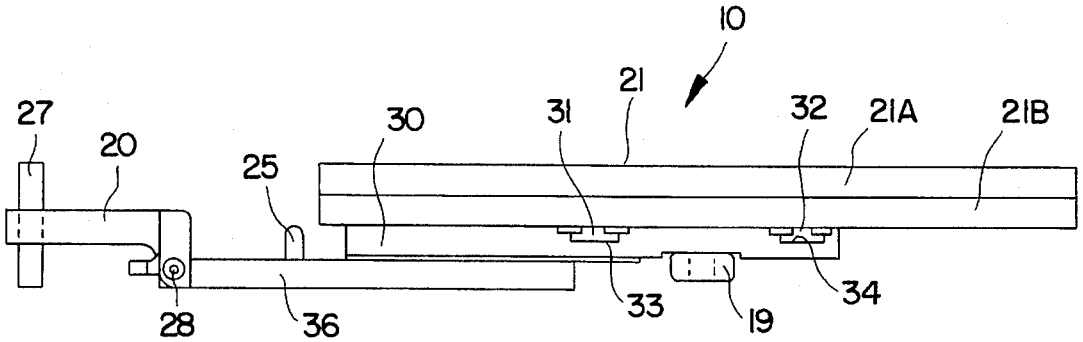
FIG. 8 is a side elevation of the tray table.
Figure 9:
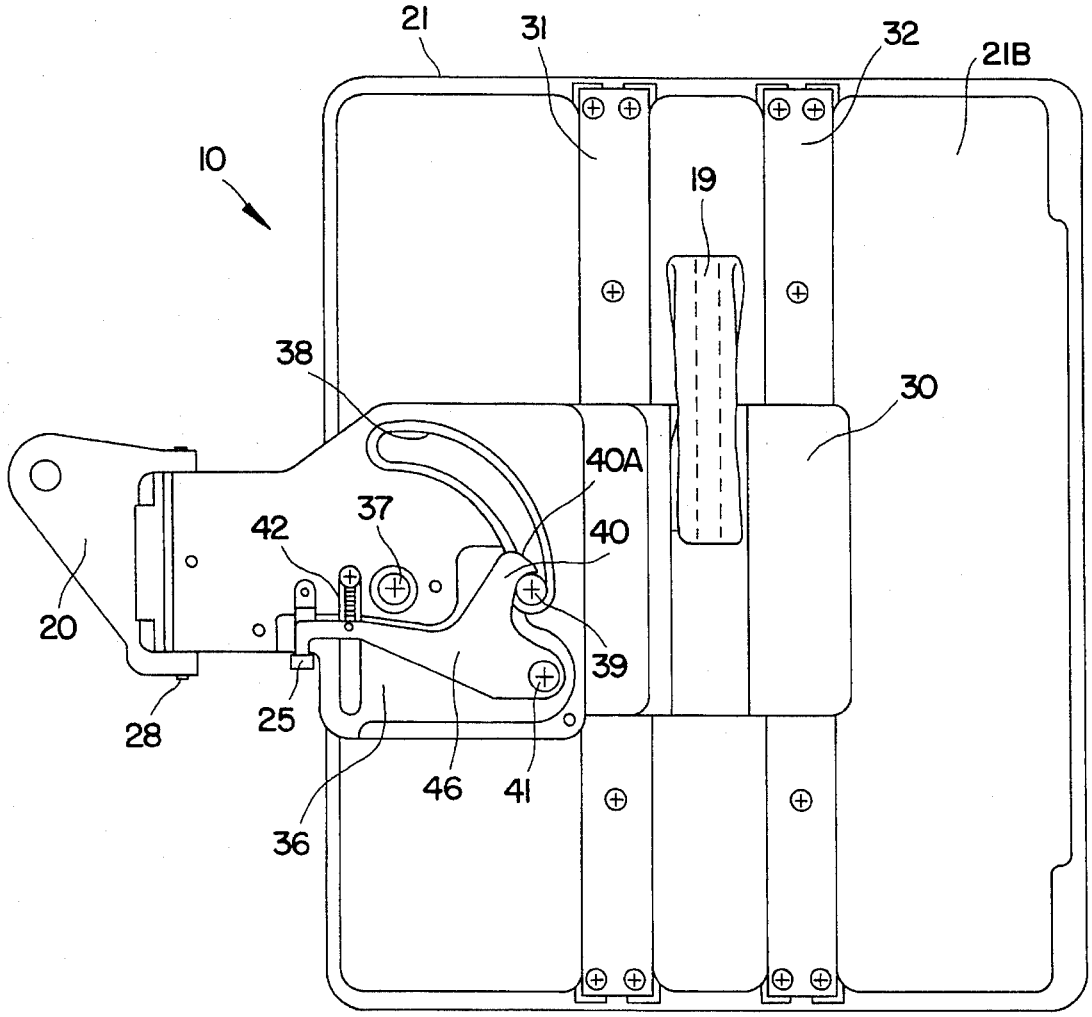
FIG. 9 is a bottom plan view of the tray table.
Figure 10:
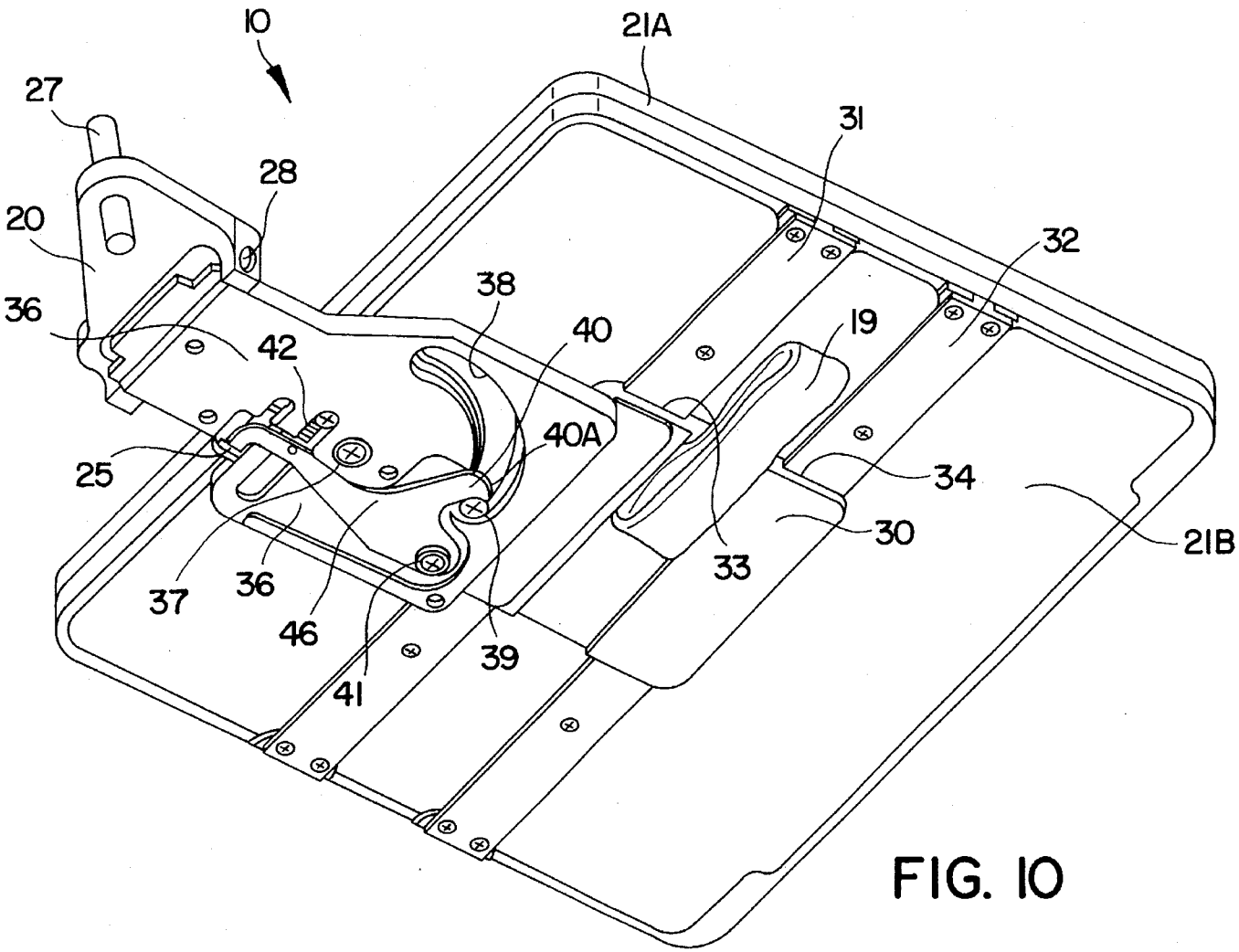
FIG. 10 is a perspective bottom view of the tray table.

The tray table 10 shown in the drawings is a left-hand version, but operates the same in both left-hand and right-hand versions. Thus, the description below, while of a left-hand version, is applicable to both left and right-hand versions. As the description proceeds, the general functions of the seat 11 will be explained (FIGS. 1–7), followed by a more detailed explanation of how the functions result from the design of the tray table 10 (FIGS. 8–10).

Seat 11 includes a seat back 12, a seat bottom 13, a foot rest 14, a center armrest 15, and an aisle armrest 16. The aisle armrest 16 is hinged and swings open, as shown in FIG. 1, to reveal a seat tray table stowage compartment 17 which holds the tray table 10 in its stowed position. In other seat configurations the tray table 10 may be stored in center armrests, as in triple seats.

To use the tray table 10, a loop 19 positioned on the top edge of the tray table 10 when stowed is grasped with the right hand and pulled upwardly and forwardly. Tray table 10 pivots from the stowage compartment 17 on a laterally-extending pivot assembly 20 which connects the tray table 10 to the seat 11, revealing a table top 21, which is formed of a pair of table top sections 21A and 21B. A hook (not shown) may be integrally formed with or attached to pivot block 36 in substitution for the loop 19.

Figure 2:
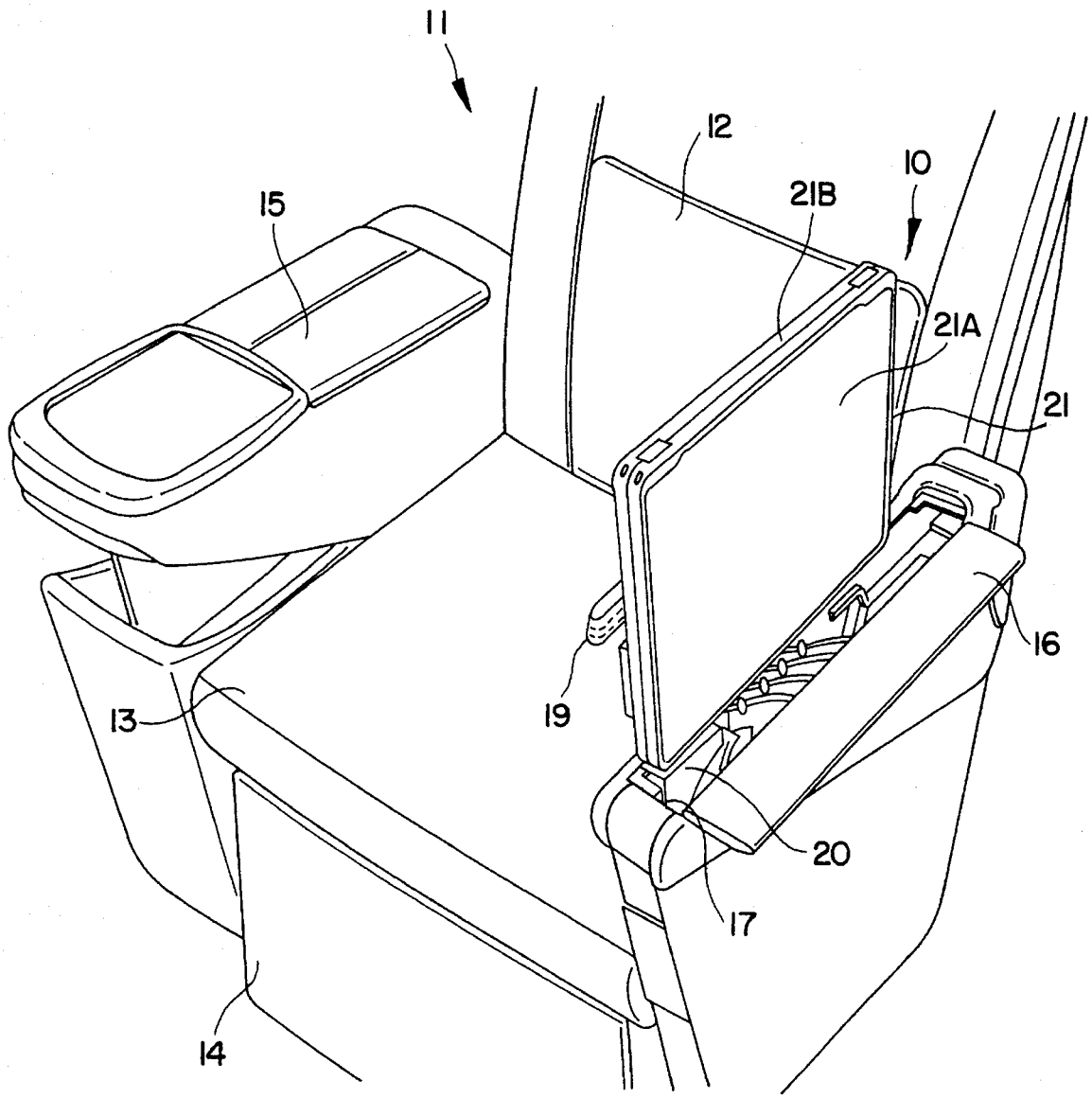
FIG. 2 is a view according to FIG. 1 showing movement of the tray table from the armrest compartment.
Figure 3:
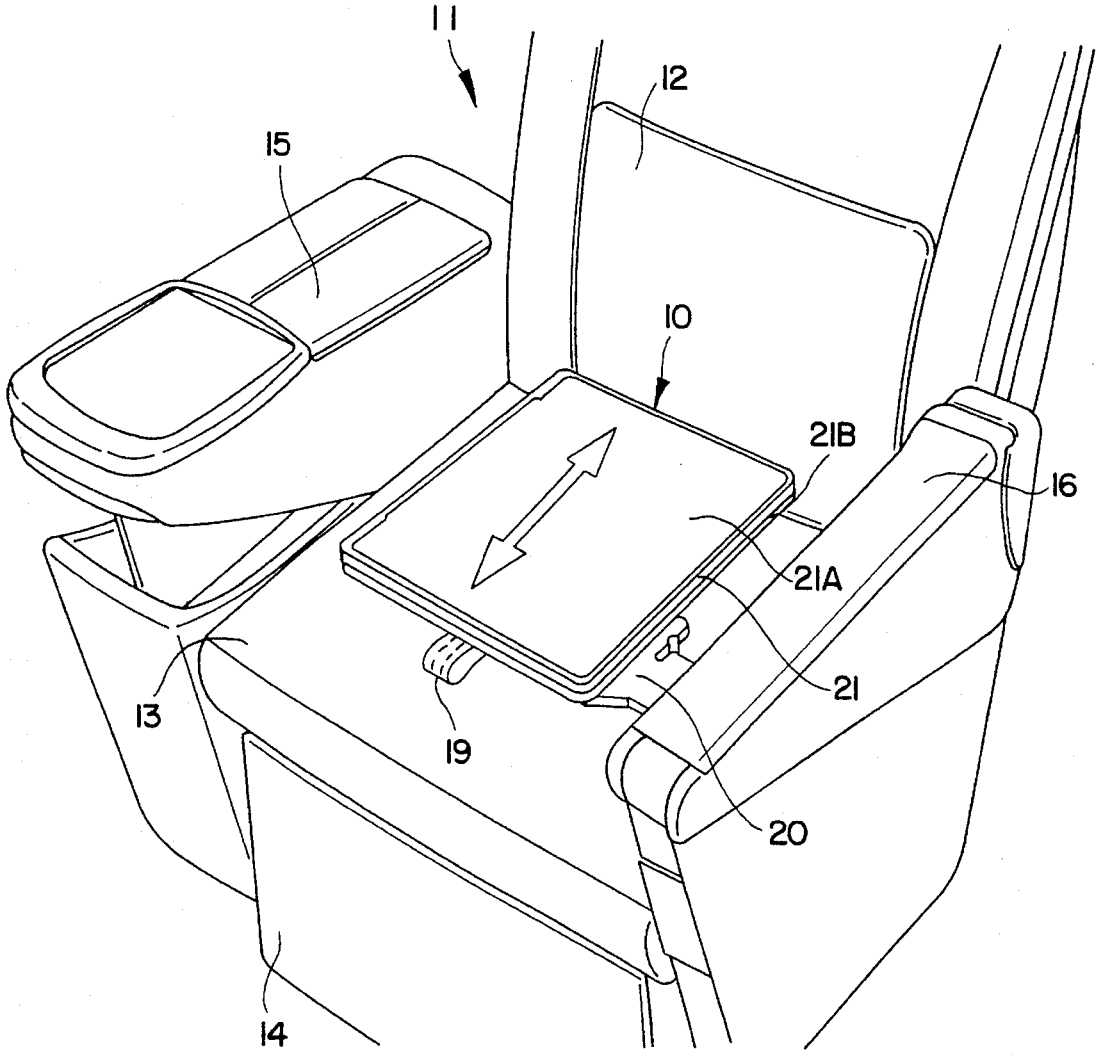
FIG. 3 is a view according to FIG. 1 showing further movement of the tray table from the armrest compartment into a first use position.

When the table top 21 reaches the position shown in FIG. 2, the table top 21 has been pivoted 90° (note that the loop 19 is now on the front of the table top 21) and can be pivoted downwardly 90° into a use position, shown in FIG. 3. At this point, the arm rest 16 is lowered into a position covering the compartment 17.

The position shown in FIG. 3 comprises a first use position, and permits the seat occupant some mobility, for example to cross legs, while nevertheless having room for a drink, a book or some other small object. In this position, the table top 21 slides front-to-back, as shown by the arrows, so that the occupant can move the table closer or further away.

Figure 4:
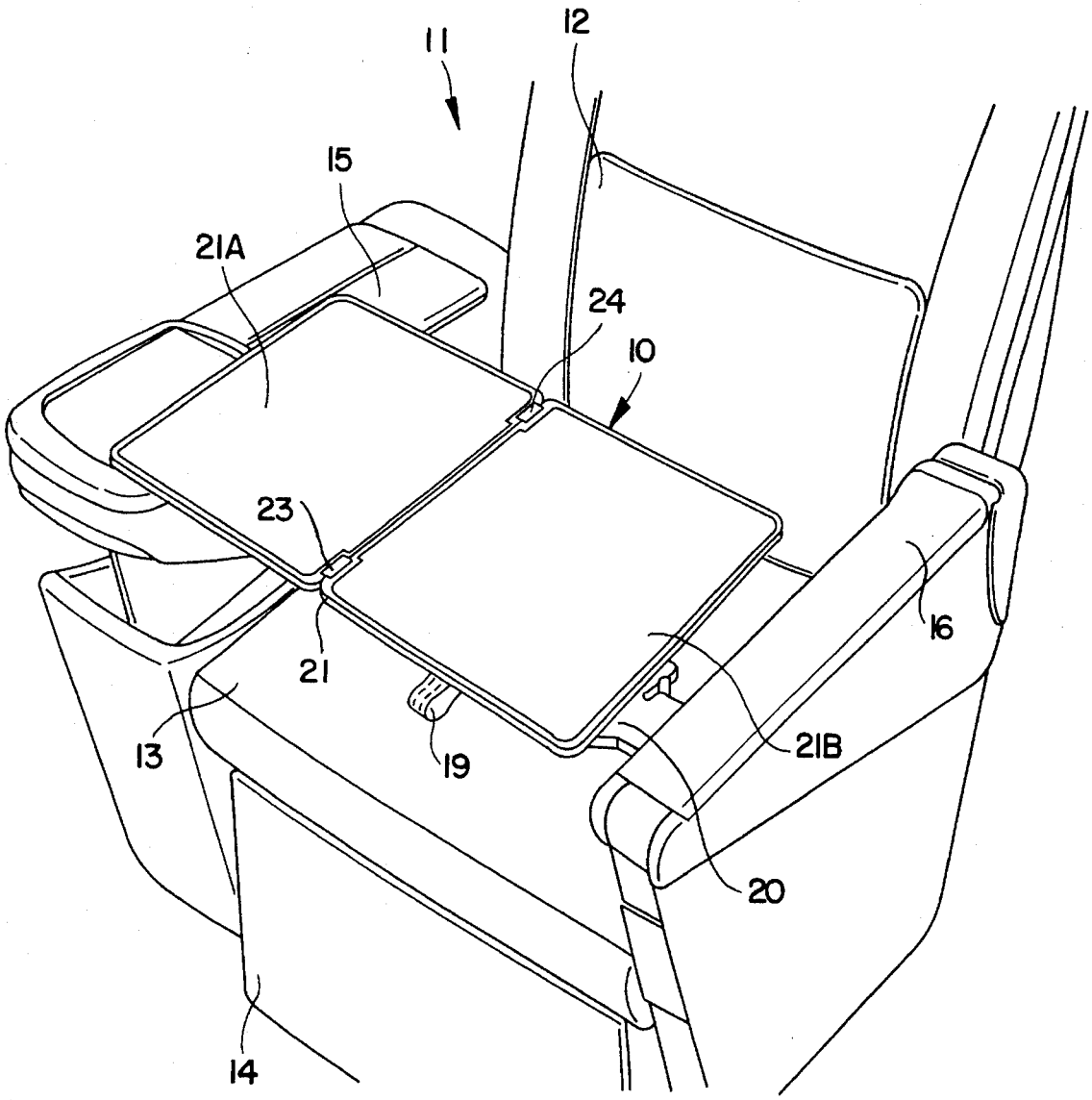
FIG. 4 is a view according to FIG. 1 showing movement of the tray table from the first use position into the second use position completely across the seat from one side to the other.

Referring now to FIG. 4, the table top sections 21A and 21B are hinged along an axis perpendicular to the long side of the table top by hinge assemblies 23 and 24. By pivoting the table top section 21B away from the table top section 21A, the tray table 21 becomes a full-length table suitable for dining or providing a work surface. The long side of the table top 21 extends transversely from one side of the seat to the other, and is sufficiently long to extend completely from one side of the seat 11 to the other, with the free end of the table top section 21B being supported on edge of the armrest 15. In this position, the table top 21 slides front-to-back, so that the occupant can move the table closer or further away, in exactly the same manner as with the table top 21 in the position shown in FIG. 3.

Figure 5:
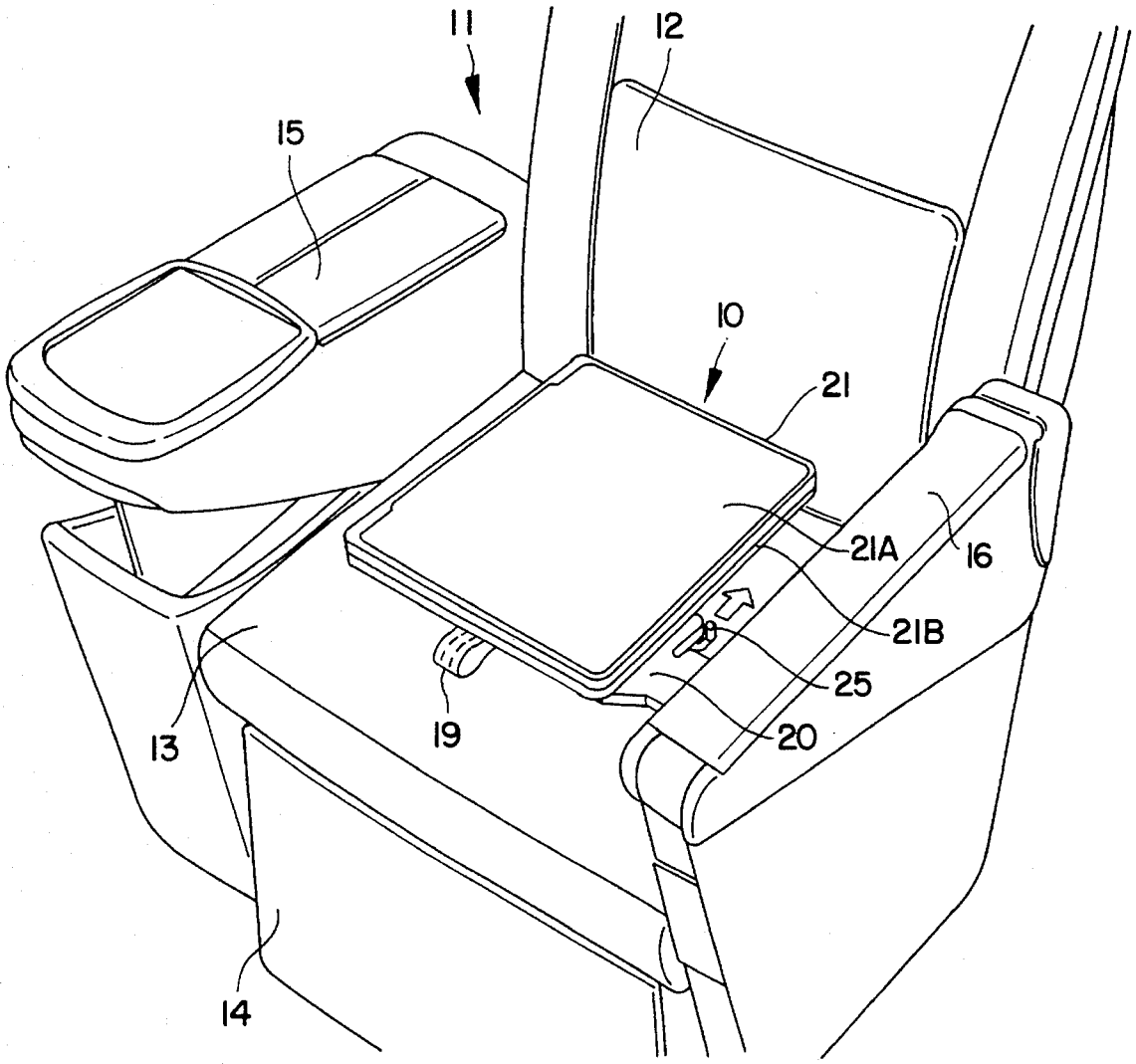
FIG. 5 is view according to FIG. 1 showing movement of the unlocking lever to permit movement of the tray table from the first use position into the ingress/egress position.
Figure 6:
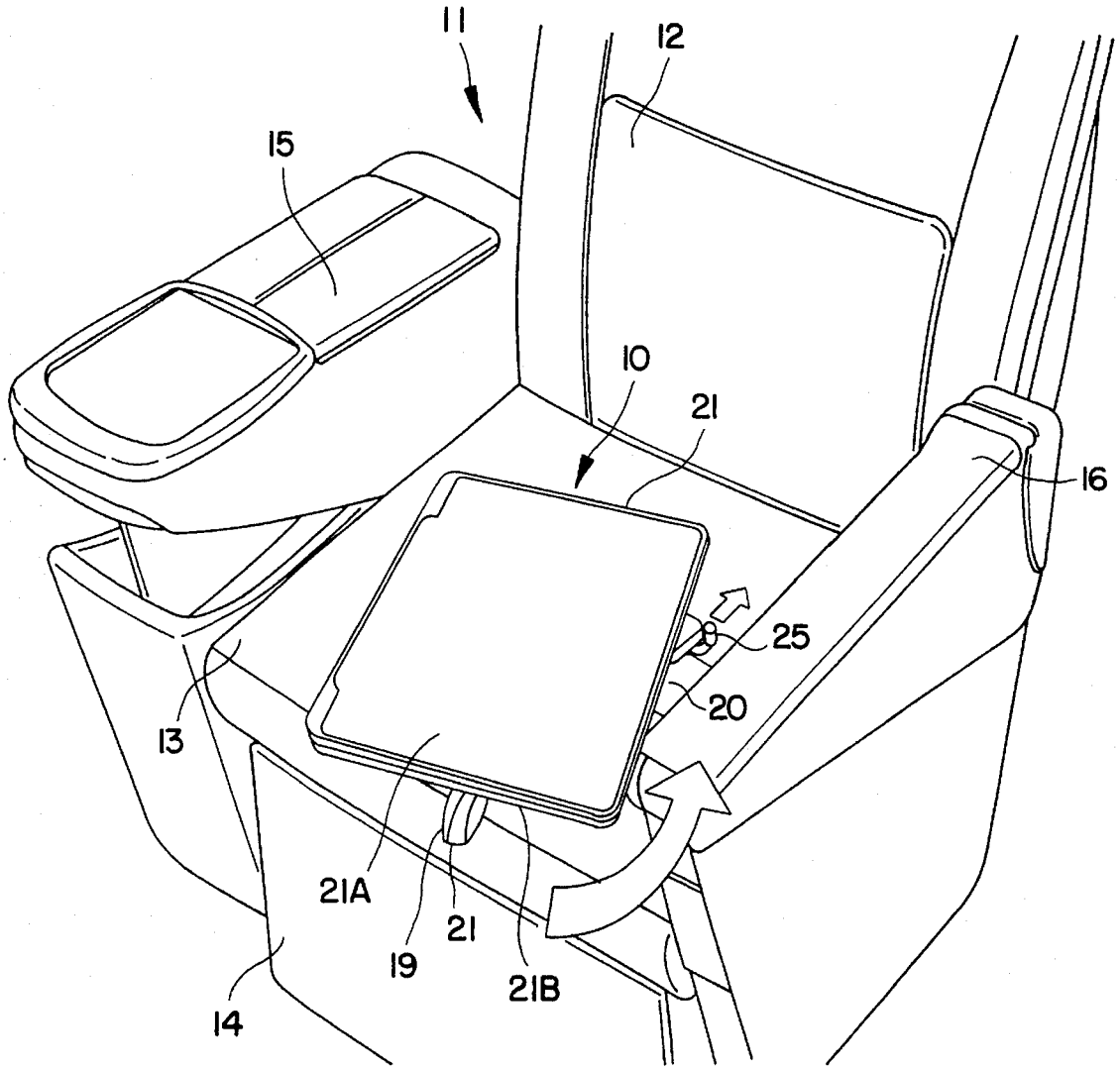
FIG. 6 is a view according to FIG. 1 showing movement of the tray table from the first use position into the ingress/egress position.
Figure 7:
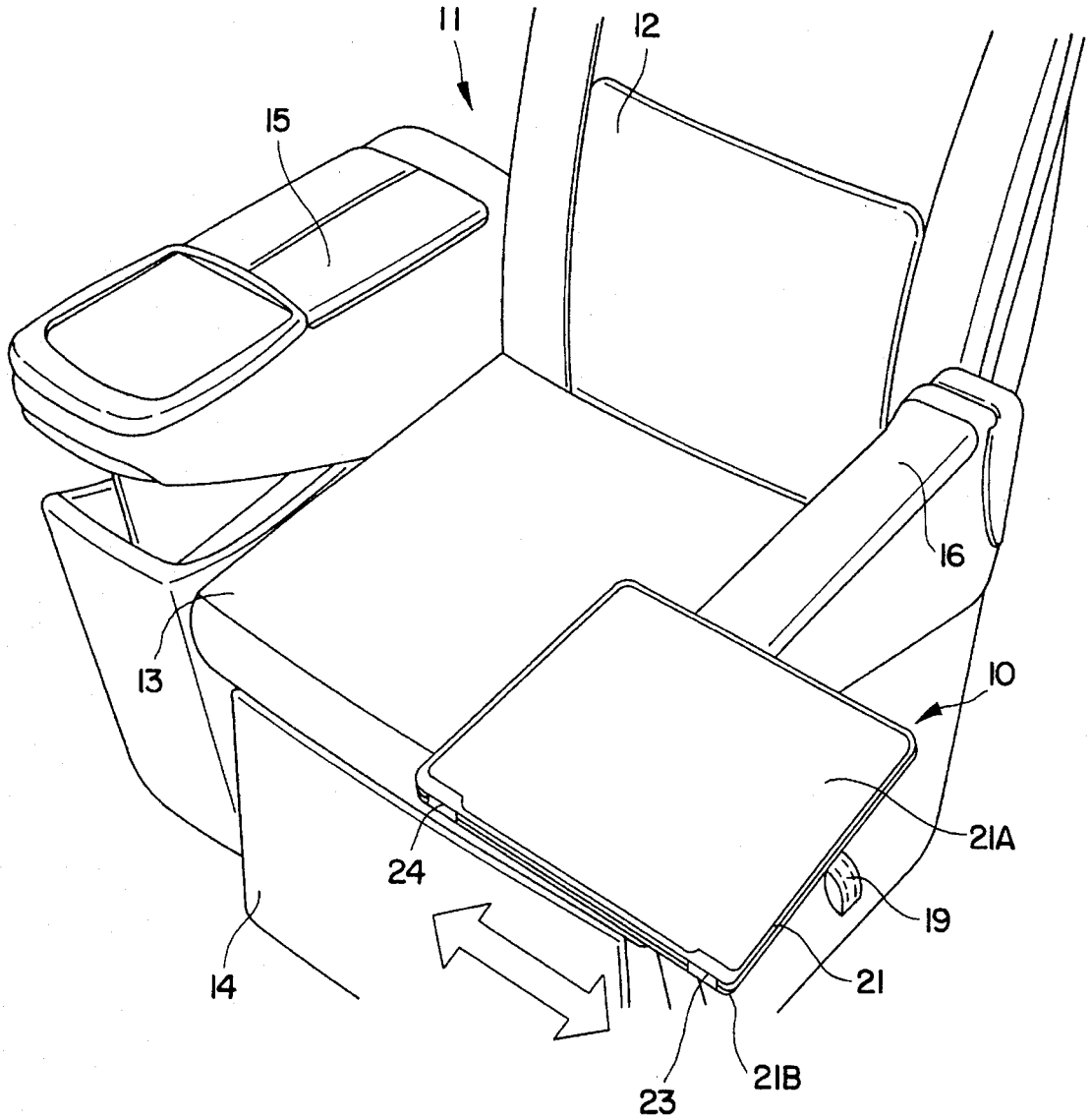
FIG. 7 is a view according to FIG. 1 showing translational movement of the tray table from a first ingress/egress position into a second ingress/egress position.

Referring now to FIGS. 5–7, the steps for moving the table top 21 into an ingress/egress position is illustrated. First, the table top section 21B may be folded back onto the table top section 21A, as shown if desired. Then an unlocking lever 25 is pulled by the occupant in the direction shown in FIG. 5, which releases the table top 21 from its use position. As is shown in FIGS. 6 and 7, the table top 21 is then permitted to pivot 90°, so that the long side of the table top sections 21A and 21B now extends front to back instead of transversely, as described above. If the table top 21 is in use, it may be pivoted without folding the section 21B over onto section 21A.

FIG. 7 illustrates the ingress/egress position. Within this position there exists a range of side-to-side translation motion which permits to the occupant to, for example, move the table top 21 completely to the side so that he or she can leave and return to the seat. Note that the table top 21 does not pivot into the access area in front of the seat when it is in its ingress/egress position. Therefore, passage of other passengers to and from their seat past the seat 11 is not impeded.

Now that the overall functions of the tray table have been explained, a more specific, detailed explanation of the construction of the tray table is illustrated in FIGS. 8–10. The pivot assembly 20, which connects the tray table to the seat 11, includes a pivot pin 27 which attaches the entire tray table to the seat 11. Pivot assembly 20 also includes a pivot pin 28 which pivots at right angles to pivot pin 27, and which permits the table top 21 to be lowered from the position shown in FIG. 2 to the position shown in FIG. 3.

The pivot assembly 20, which connects the tray table to the seat 11 also includes a table translation assembly and a table pivot assembly for permitting independent pivotal and translational movement of the table top 21.

The table translation assembly includes a mounting block 30 which is mounted by a pair of parallel tracks 31, 32 which extend across the short side of the table top section 21A from one side to the other. The tracks 31, 32 are retained in slots 33, 34 on the top surface of the mounting block 30. Tracks 31, 32 are fabricated of low-friction Delrin and permit easy movement of the table top 21 by applying light pressure to the front or rear of the table top 21 to move it in the desired direction. Nylon or other plastics may also be used.

This translational movement serves two separate functions. In the table configuration shown in FIGS. 3 and 4, the movement of the table top 21 along the tracks 31, 32 moves the table top 21 towards or away from the seat occupant. Thus, the occupant can adjust the seat to a dining or working distance, or adjust for body size.

In the ingress/egress position configuration shown in FIG. 7, the table top 21 has been pivoted 90°. Thus, the same translational movement moves the table top 21 from side to side. The position of the table top 21 on the side of the seat 11 enables the translational movement to move the table almost completely out of the way to permit the occupant to leave the seat and subsequently return to it. The table top 21 can also be positioned by the occupant to hold food or drink off to the side so that the seating is more comfortable. The degree of pivot can be limited to less than 90° if necessary due to user requirements.

The table pivot assembly includes the mounting block 30. A pivot block 36 is pivotally mounted on the mounting block 30 by a pivot pin 37. The pivot block 36 has an arcuate guide slot 38 into which extends a guide pin 39. The guide pin 39 arrests movement of the table top 21 by engaging the ends of the guide slot 38 at the opposite extremes of travel. In the position of the guide pin 39 shown in FIGS. 9 and 10, orientation of the table top 21 is such that the translation accomplished by the movement of the mounting block on the tracks 31, 32 is towards and away from the occupant, as described above.

In this position, the table top 21 is locked, meaning that it cannot be pivoted merely by turning the table top 21 about a vertical axis defined by the pivot pin 37. The locked position of the table top 21 is achieved by a hook 40 mounted on a pivot pin 41. The hook 40 is biased in the locking position by a spring 42 connected by one end to the pivot block 36 and by the other end to the unlocking lever 25 of the hook 40. As is best shown in FIGS. 9 and 10, the hook 40 traps the guide pin 39 against one end of the guide slot 38, locking the table top 21 into the use position.

As is shown in FIG. 9, to release the lock the unlocking lever 25 is pulled towards the occupant. This movement overcomes the biasing force of the spring 42 and pulls the hook 40 away from the guide pin 39, releasing it and permitting the occupant to then pivot the table top 21 as shown in FIGS. 6 and 7. The table top 21 may be pivoted to the extent of the arc of the guide slot 38, so that when the other end of the guide slot 38 reaches the stationary guide pin, pivotal movement of the table top 21 ceases.

To return the table top 21 to its locked, use position, the table top is pivoted in the opposite direction. When the guide pin 39 reaches the hook 40, additional force is required to overcome the biasing force of the spring 42. Note that the nose of the hook 40 has an oblique interference surface 40A. When the guide pin 39 hits the interference surface 40A, application of additional force against the oblique surface will push the hook 40 out of the way, permitting the guide pin 39 to reach the end of its travel against the end of the guide slot 38. Once the guide pin 39 has passed the hook 40, the spring 42 pulls the hook 40 back into the locking position.

The combination of the pivoting movement and the translating movement described above provides a very wide range of adjustment, so that the table top 21 can be moved into many different positions to suit the comfort and needs of the seat occupant.

A stowable seat tray table is described above. Various details of the invention may be changed without departing from its scope. Furthermore, the foregoing description of the preferred embodiment of the invention and the best mode for practicing the invention are provided for the purpose of illustration only and not for the purpose of limitation the invention being defined by the claims.

I claim:

1. A stowable seat tray table for use with a seat having a tray table stowage compartment on one side thereof, comprising:

(a) a tray table having a long side and a perpendicular short side;

(b) connecting means for connecting the table to the seat and for permitting the table to be moved into and out of the stowage compartment;

(c) said connecting means including table pivot means and table translating means, said pivot means and said table translating means cooperating with said table for moving the table when out of the stowage compartment between:

(1) a use position wherein the long side of the table extends across the seat from one side to an opposing side for use by an occupant; and (2) an ingress/egress position at a substantially right angle to the use position wherein the table is pivoted about a vertical axis by the pivot means and laterally translated while remaining in the horizontal plane of the use position towards the stowage compartment by the translating means to provide sufficient room for the occupant to ingress to or egress from the seat without removing items from the tray;

(d) said table pivot means comprising:

(1) a mounting block attached to a bottom surface of the table;

(2) a pivot block pivotally mounted on said mounting block;

(3) an arcuate guide slot formed in said pivot block; and (4) a guide pin mounted on said mounting block in a fixed position and extending upwardly into said guide slot for limiting pivotal movement of said pivot block to the arc of the arcuate guide slot; and (e) said table including locking means cooperating with said table pivot means for locking the table in the use position, said locking means comprising a hook for holding the guide pin in a predetermined locked position in said guide slot.

2. A seat tray table according to claim 1, wherein said tray table is comprised of two table top sections hinged along an axis perpendicular to the long side of the table for permitting the table to be folded for stowage and for use as a small cocktail table.

3. A seat tray table according to claim 1, wherein said hook is pivotally mounted on said pivot block and includes biasing means for biasing said hook over the guide slot in an interference position with relation to said guide pin, and wherein a predetermined force on said hook by the pin overcomes said biasing means and moves the pin past the hook into the locked position.

4. A seat tray table according to claim 3, wherein said locking means includes an unlocking lever carried by said hook for releasing said guide pin from its locked position in the guide slot.

5. A seat tray table according to claim 1, wherein said mounting block is mounted on the bottom surface of said table for translational movement relative to said table.

6. A seat tray table according to claim 1, and including slide means carried on the bottom surface of the table for carrying the mounting block for translational movement of the mounting block along the slide means.

7. A seat tray table according to claim 6, wherein said slide means comprises first and second parallel tracks mounted to the bottom surface of the table, and wherein said mounting block includes first and second parallel-extending channels within which said parallel tracks are mounted for sliding, translational movement.

* * * * *